US006308858B1

(12) United States Patent
Koefelda

(10) Patent No.: US 6,308,858 B1
(45) Date of Patent: Oct. 30, 2001

(54) STORAGE CONTAINER

(75) Inventor: Gerald R. Koefelda, Hermosa Beach, CA (US)

(73) Assignee: Rehrig Pacific Company, Los Angeles, CA (US)

( * ) Notice: Subject to any disclaimer, the term of this patent is extended or adjusted under 35 U.S.C. 154(b) by 0 days.

(21) Appl. No.: 09/457,051

(22) Filed: Dec. 7, 1999

(51) Int. Cl.[7] ..... B65D 1/00
(52) U.S. Cl. ..... 220/608; 220/669
(58) Field of Search ..... 220/571, 608, 220/609, 623, 624, 669, 4.04

(56) References Cited

U.S. PATENT DOCUMENTS

| | | | |
|---|---|---|---|
| D. 312,573 | | 12/1990 | Poirier . |
| D. 319,016 | | 8/1991 | Kahl . |
| D. 326,815 | | 6/1992 | Meisner . |
| D. 326,945 | | 6/1992 | Howitt . |
| D. 351,284 | | 10/1994 | Kruger . |
| D. 363,604 | | 10/1995 | Koenig et al. . |
| D. 382,112 | | 8/1997 | Egan . |
| D. 395,756 | | 7/1998 | Tanji . |
| D. 421,183 | | 2/2000 | Koskinen . |
| D. 429,565 | | 8/2000 | Aiken . |
| 3,043,461 | | 7/1962 | Glassco . |
| 3,405,858 | | 10/1968 | Collie . |
| 3,583,623 | | 6/1971 | Golner et al. . |
| 4,206,845 | | 6/1980 | Christian . |
| 4,349,124 | | 9/1982 | Faller . |
| 4,442,969 | | 4/1984 | Holden . |
| 4,932,557 | | 6/1990 | Yeo . |
| 5,042,674 | | 8/1991 | Ramsay et al. . |
| 5,046,636 | | 9/1991 | Coskery . |
| 5,183,180 | * | 2/1993 | Hawkins et al. ..... 220/669 X |
| 5,236,340 | * | 8/1993 | Hall et al. ..... 220/608 X |
| 5,373,958 | | 12/1994 | Bokmiller . |
| 5,449,087 | * | 9/1995 | Mikula et al. ..... 220/608 |
| 5,456,379 | * | 10/1995 | Krupa et al. ..... 220/608 X |
| 5,471,718 | * | 12/1995 | Harrill ..... 220/669 X |
| 5,472,139 | | 12/1995 | Valdman et al. . |
| 5,484,072 | * | 1/1996 | Beck et al. ..... 220/609 X |
| 5,531,352 | | 7/1996 | Kraft et al. . |
| 5,607,709 | * | 3/1997 | Fritz et al. ..... 220/608 X |
| 5,881,908 | | 3/1999 | Hays et al. . |
| 5,967,322 | | 10/1999 | Apps et al. . |
| 6,007,854 | | 12/1999 | Cadiente et al. . |
| 6,079,587 | | 6/2000 | Vogt . |

* cited by examiner

*Primary Examiner*—Steven Pollard
(74) *Attorney, Agent, or Firm*—Brooks & Kushman PC

(57) ABSTRACT

A plastic container includes at least one side wall member and a bottom portion integrally formed with the at least one side wall. The bottom portion has an outer surface with a generally concave shape, the outer surface including at least one recessed portion formed therein for allowing drainage from the outer surface when the container is in an inverted orientation.

24 Claims, 15 Drawing Sheets

STORAGE CONTAINER

TECHNICAL FIELD

This invention relates to a storage container adapted to store and transport objects therein.

BACKGROUND ART

Containers used for transport and storage typically have flat bottoms. When such a container is made of plastic, the flat bottom may not provide adequate strength, support and stability to the container. Particularly, when the container is used to store and transport relatively heavy items, these items exert a load upon the already flat bottom surface, sometimes causing the bottom surface to suffer creep deformation and bow downward over time, thus limiting the life and reusability of the container. This is particularly true when the container is made to stack on a similar container. Under these circumstances, it may be more difficult for the container having a deformed bottom to stack with like containers in a stable manner. When a flat bottom container is inverted and is washed or otherwise exposed to the elements, water and other liquid may also tend to collect on the bottom of the container.

U.S. Pat. No. 5,046,636 issued to Coskery discloses a refuse recycling box having a flat bottom which is separated by flow channels. This flat bottom, like other flat bottom containers, will tend to creep, deform and bow downward under a given load, especially as a long-term consequence.

Thus, there is a need for an improved storage container which is capable of withstanding the loads exerted upon it during transport and storage of objects. The storage container should be robust, durable, and have strength and stability. The container should be able to support loads without great deformation. The container should also be capable of stacking and nesting with like containers. Further, the container should allow for drainage of water and other liquids when in an inverted orientation.

DISCLOSURE OF INVENTION

It is a principal object according to the present invention to provide a storage container which is robust, strong, and durable under a given load.

It is another object according to the present invention to provide a plastic storage container which is relatively inexpensive and easy to manufacture.

It is yet another object according to the present invention to provide a storage container which is capable of stacking and nesting with a like container.

It is still another object according to the present invention to provide a storage container which is designed to reduce the likelihood of creep and deformation.

It is still yet another object according to the present invention to provide a storage container which allows for drainage when in an inverted position.

Accordingly, a plastic storage container is provided which includes at least one side wall portion and a bottom portion integrally formed with the at least one side wall portion. The bottom portion has an outer surface with a generally concave shape. The outer surface includes at least one recessed portion formed therein for allowing drainage from the outer surface when the container is in an inverted orientation. The at least one side wall portion may be a substantially cylindrical side wall portion, or it may also be two pairs of opposed side wall portions which are integrally formed with each other as well as the bottom portion. The at least one recessed portion includes a second recessed portion formed therein for allowing drainage from the outer surface when the container is in an inverted orientation.

In another embodiment, a storage container is provided which includes a first pair of opposed side walls and a second pair of opposed side walls which are integrally formed to each other. The container also includes a bottom portion which is formed integrally with the first and second pairs of opposed side walls. The bottom portion has an outer surface defining a generally concave shape. The outer surface includes at least one recessed portion extending between the first pair of opposed side walls. The at least one recessed portion bisects the bottom portion. The at least one recessed portion includes a second recessed portion which extends between the second pair of opposed side walls. Moreover, the at least one recessed portion defines a plurality of downwardly projecting portions. The bottom portion includes an inner surface which has a corresponding convex surface.

In still another embodiment provided according to the present invention includes a first pair of opposed side walls, and a second pair of opposed side walls which are integrally formed with the first pair of opposed sidewalls. Also included is a bottom portion which is integrally formed with both the first pair of opposed side walls and the second pair of opposed side walls and which together define a compartment area. The bottom portion has an outer surface with a recessed channel portion which extends between one of the first and second pairs of opposed sidewalls and also includes a recessed central portion. The bottom surface is bowed gradually inward toward the compartment area such that the bottom portion is angled inward from its outboard portion toward the central portion. In a preferred embodiment, the first pair of opposed side walls and the second pair of opposed side walls are vertically tapered.

The plastic container also preferably includes a lid which is cooperable with the container for enclosing the storage compartment, as well as a handle portion on at least one side wall. Moreover, the bottom portion may include a second recessed channel portion which extends between the second pair of opposed side walls. The recessed channel portion defines a plurality of downwardly projecting portions. The bottom portion of the container includes an inner surface opposite the outer surface. The inner surface has a corresponding convex surface.

And in yet still another embodiment, provided is a plastic container which is adapted to be nested with a like container and includes a first pair of opposed side walls and a second pair of opposed side walls which are integrally formed with the first pair of opposed sidewalls. Also included is a bottom portion which is integrally formed with both the first pair of opposed side walls and the second pair of opposed side walls, together defining a compartment therein. The bottom portion has an outer surface which is defined by a generally concave shape and has at least one recessed channel portion formed therein which extends between one of the first and second pairs of opposed side walls. In a nested orientation the compartment of the plastic container receives a like container therein. To enhance the nesting, the first pair of opposed side walls and the second pair of opposed side walls are vertically tapered, being larger at the upper portions, and smaller in the lower portions.

The plastic container may also include a lid which is cooperable with the container for enclosing the compartment. The lid has an upper surface which corresponds to the outer surface of the bottom portion, such that in a stacked orientation, the lid is disposed on the plastic container and receives in a mating manner the bottom of a like container thereon. The container also preferably includes a handle portion on at least one sidewall which is adapted to be grasped in both a palm-up and palm-down orientation. The bottom portion includes a second recessed portion which extends between the second pair of opposed side walls. The recessed channel portion defines a plurality of downwardly projecting portions. The recessed channel portion is integrally formed with and open at its corresponding side wall.

The above objects and other objects, features, and advantages of the present invention are readily apparent from the following detailed description of the best mode for carrying out the invention when taken in connection with the accompanying drawings wherein like reference numerals correspond to like components.

BEST MODE FOR CARRYING OUT THE INVENTION

Figure 1:
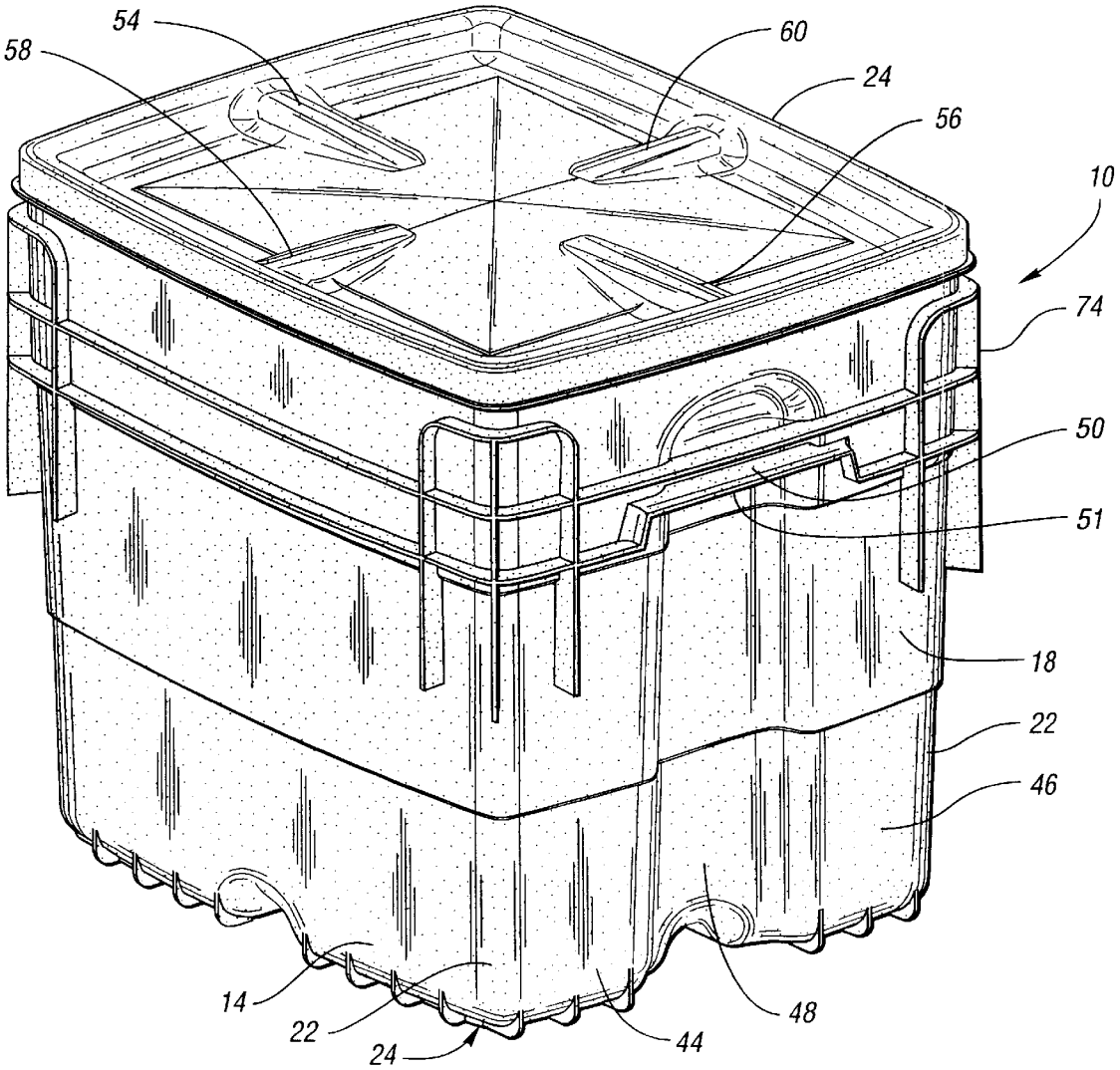
FIG. 1 is a perspective view of the storage container according to the present invention.

With reference to FIG. 1 of the drawings, a storage container 10 according to the present invention is illustrated therein. Storage container 10 is adapted to store and transport objects therein. Container 10 includes a bottom portion 12 (or base portion) and two pairs of opposed upstanding side walls integrally formed with bottom portion 12. Bottom portion 12 illustrated as polygonal and is particularly illustrated in FIGS. 1–12 as having a generally rectangular shape. The two pairs of opposed side walls are designated as side walls 14, 16 and end walls 18, 20. While the side walls and end walls are illustrated as joined by a curved corner portion 22, any transition feasible according to the objects of the present invention may be used, such as a right-angled corner portion. Container 10 is generally symmetrical about both its longitudinal and transverse center lines.

Bottom portion 12, side walls 14, 16 and end walls 18, 20 together define a storage compartment 17 (best shown in FIG. 10), adapted to receive one or more objects therein. In a preferred embodiment shown in FIGS. 1 and 2–9, container 10 further includes a lid member 24 which in its assembled or "on" position is attached to upper edge 15 of container 10 and serves to close the opening of storage compartment 17 of container 10.

Figure 2:
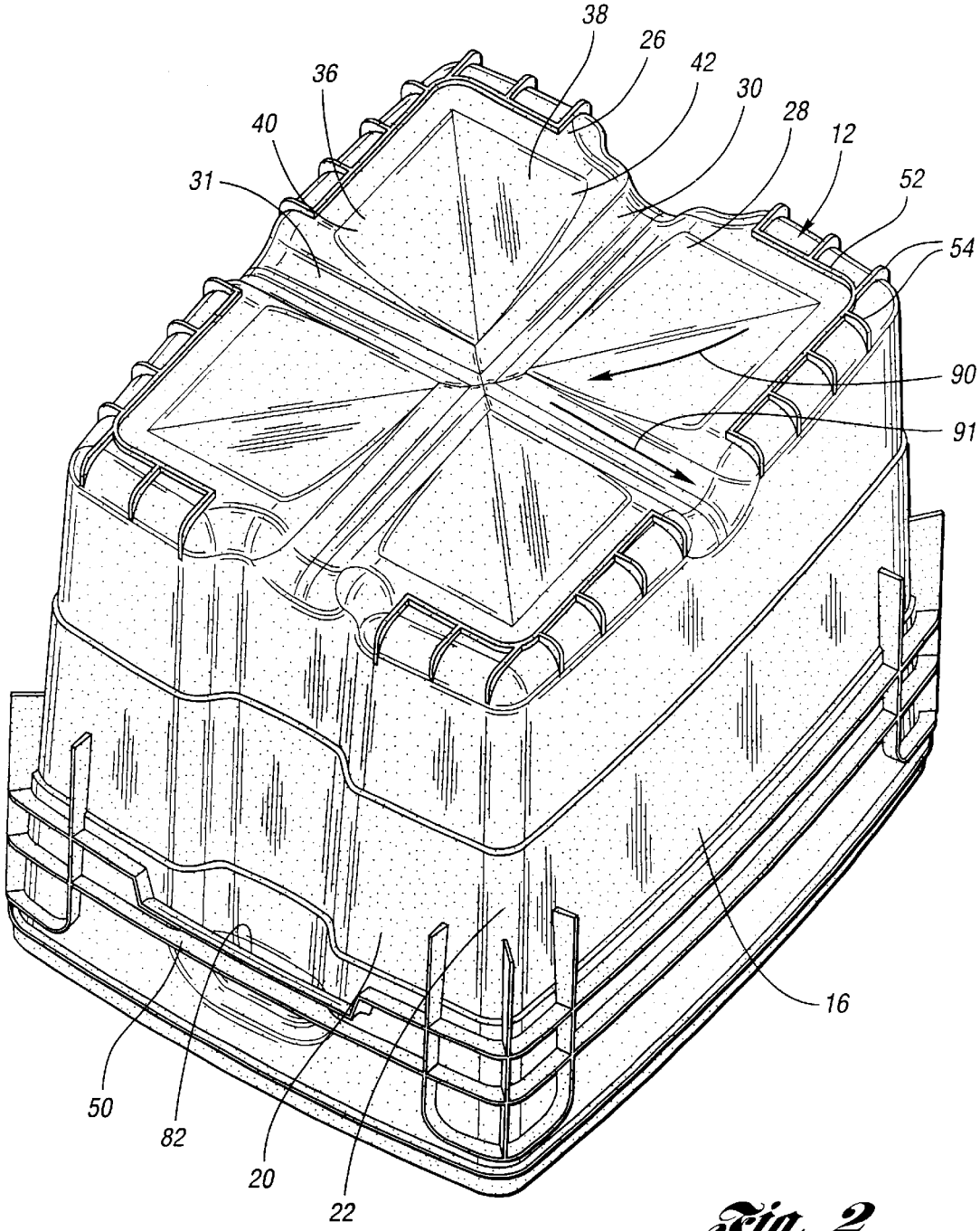
FIG. 2 is a bottom perspective view of the storage container of FIG. 1.
Figure 6:
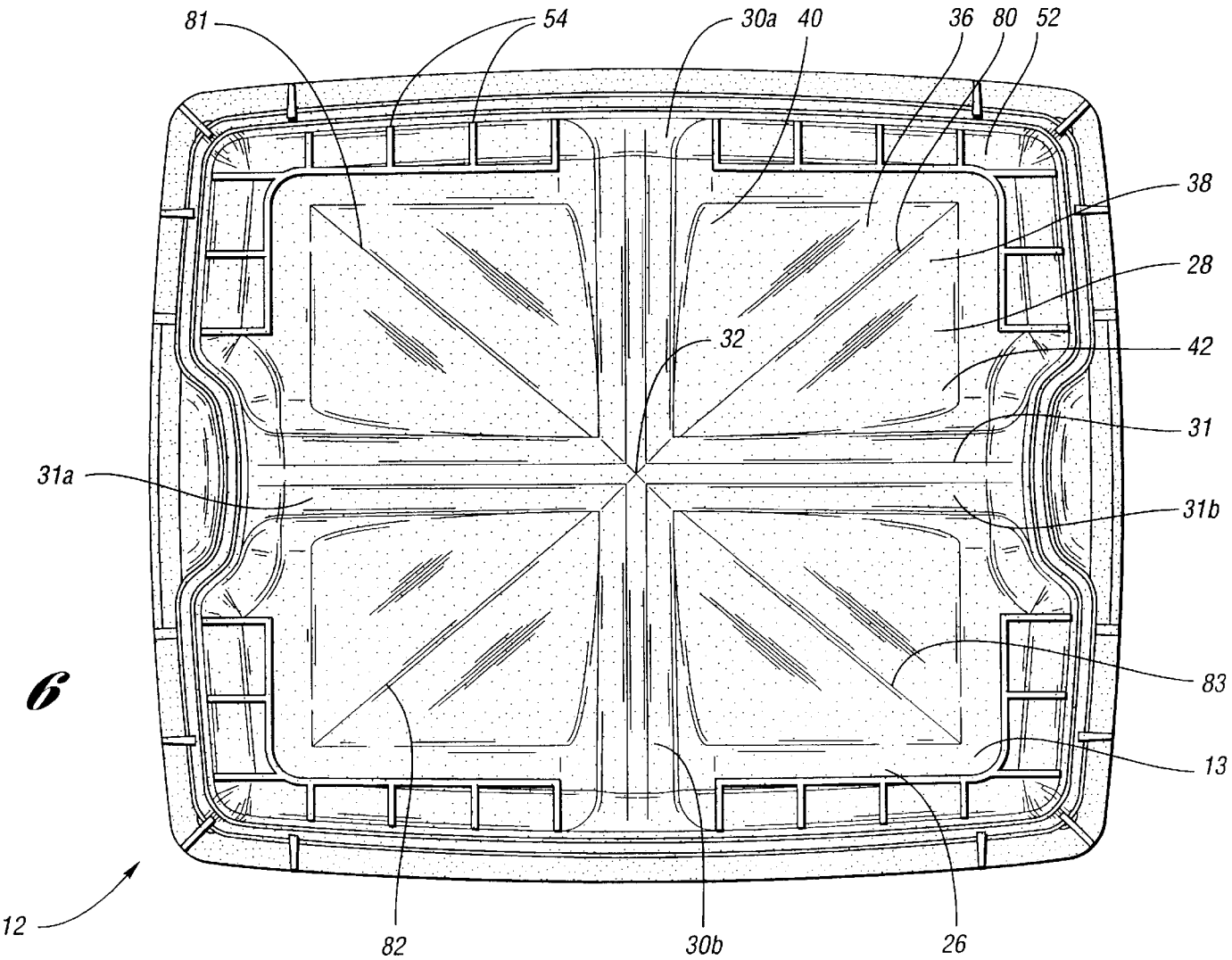
FIG. 6 is a bottom plan view of the container according to the present invention.
Figure 7:
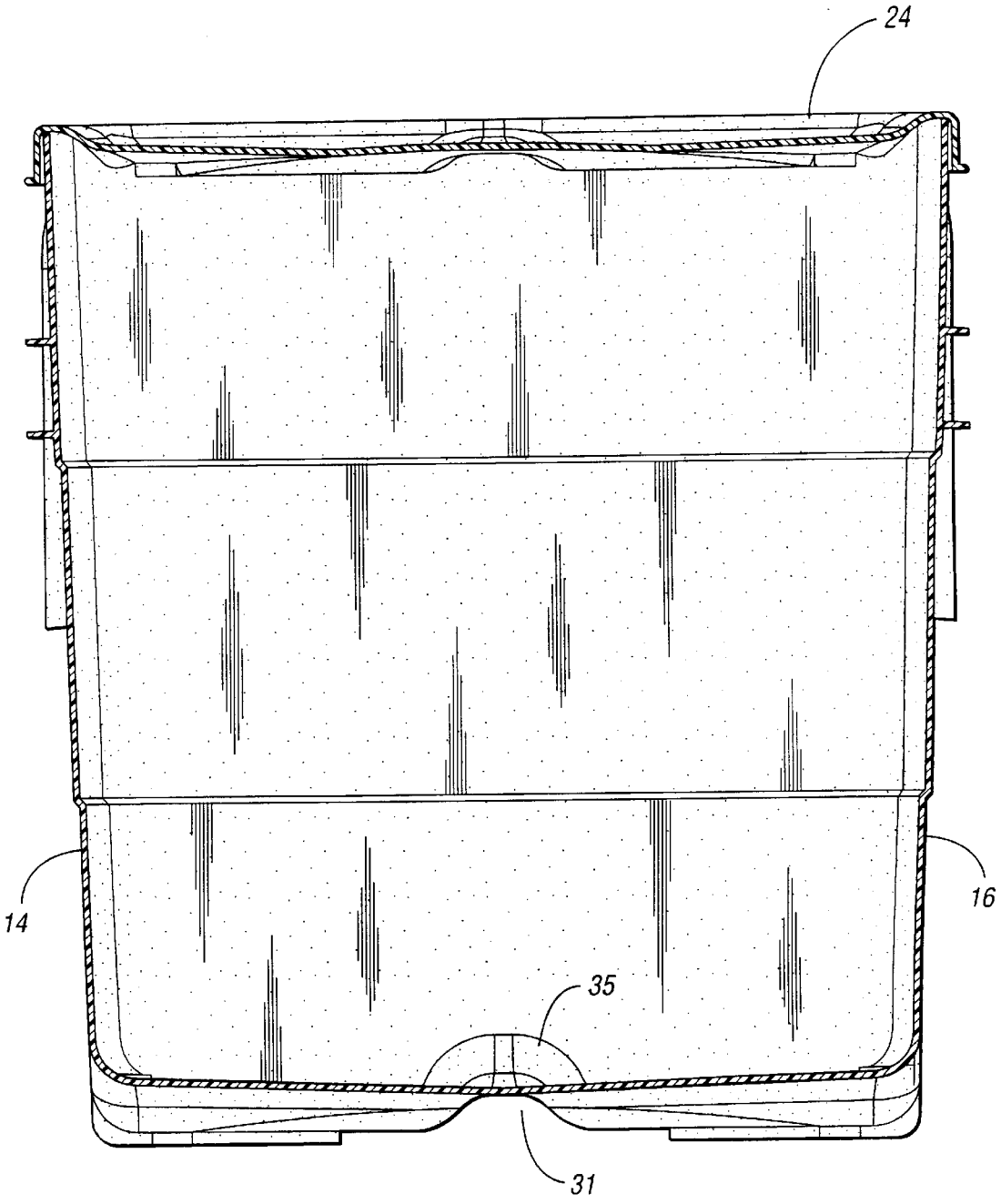
FIG. 7 is a sectional view of the storage container, taken along the line 7—7 of FIG. 3.
Figure 8:
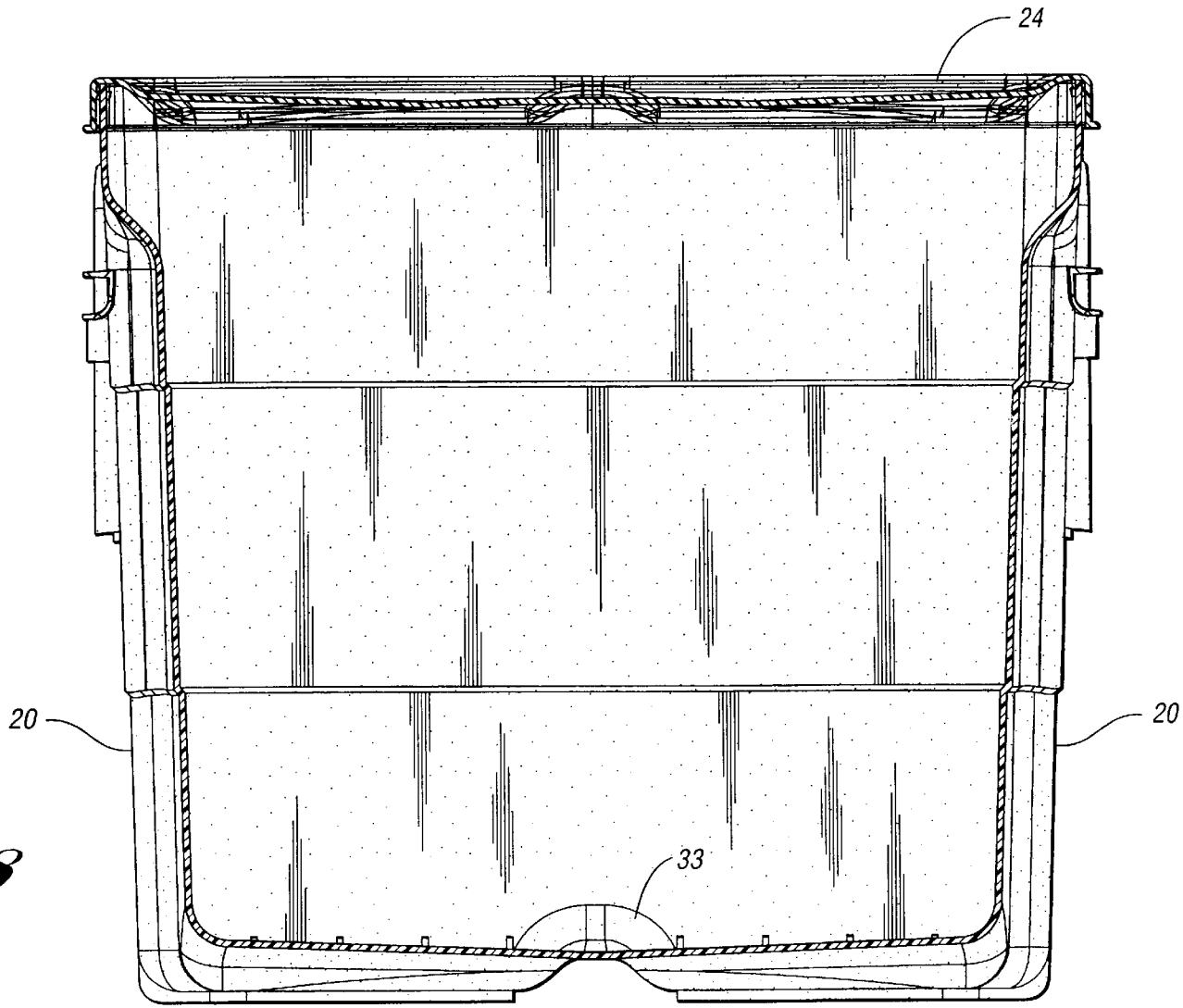
FIG. 8 is a sectional view of the storage container, taken along the line 8—8 of FIG. 3.

FIG. 2 illustrates a bottom perspective view of container 10 and FIG. 6 illustrates a bottom plan view of container 10. Bottom 12 of container 10 has an outer surface 26 (FIG. 2) and a corresponding inner surface 27 (best illustrated in FIG. 10). Outer surface 26 of container 10 has a generally concave shape. Accordingly, bottom portion 12 is gradually bowed upward and inward toward compartment 17, from its lower outboard area 13 (projecting downward) to its raised central portion 32.

Figure 10:
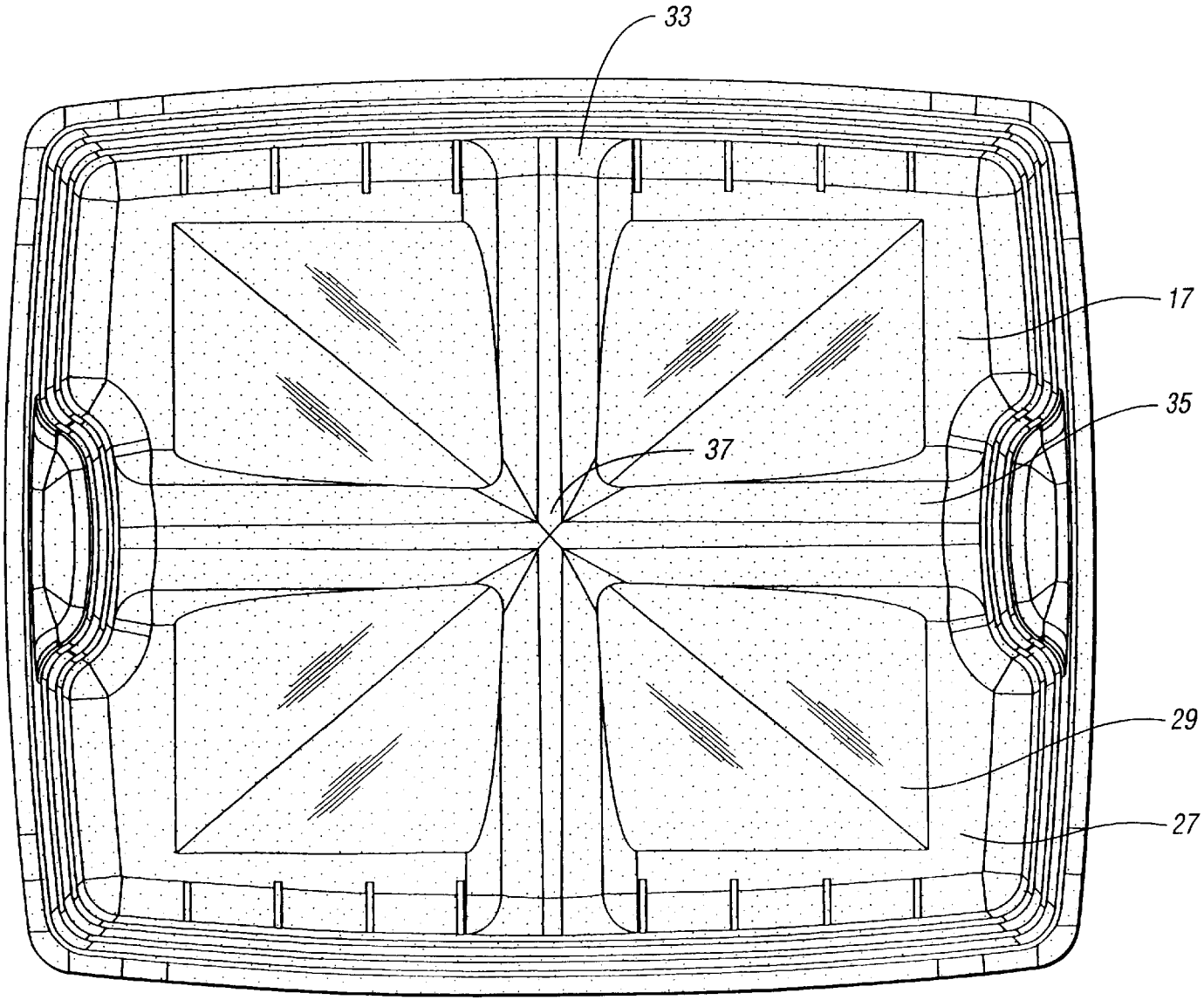
FIG. 10 is a top plan view of the storage container of FIG. 1 shown without a lid member, and thus is particularly a top plan view of the storage compartment of the storage container.

In a preferred embodiment, the generally concave shape of outer surface 26 includes a plurality of downward projecting portions 28 separated by at least one recessed channel portion 30. More particularly, FIG. 6 illustrates that bottom surface 26 includes four downwardly projecting portions 28 each directed toward a corner of bottom 12. Note that downward projecting portions 28 define recessed portions 29 in bottom inner surface 27, as shown in FIG. 10.

Figure 4:
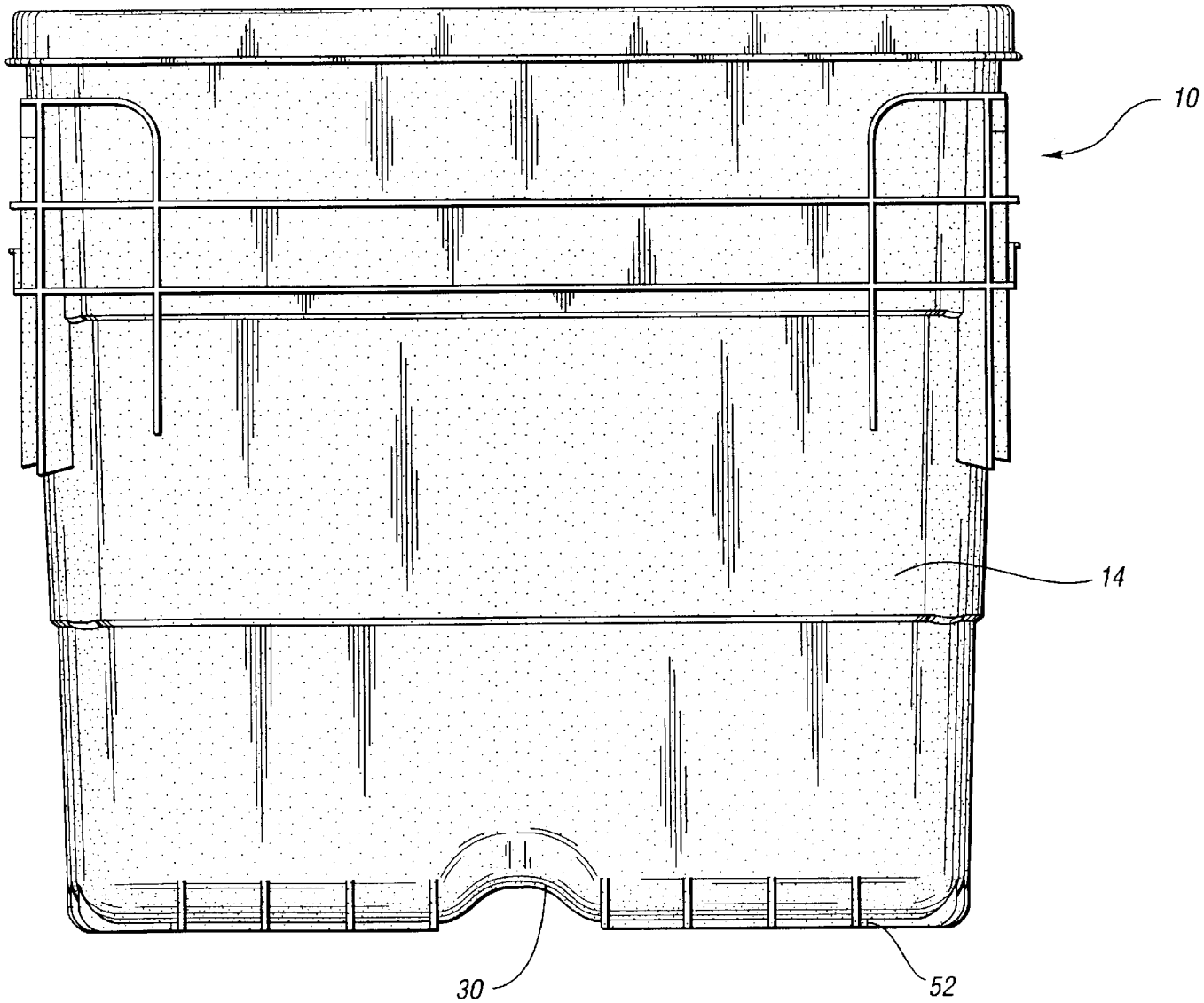
FIG. 4 is a front elevational view of the container according to the present invention, the rear elevational view being a mirror image thereof.
Figure 5:
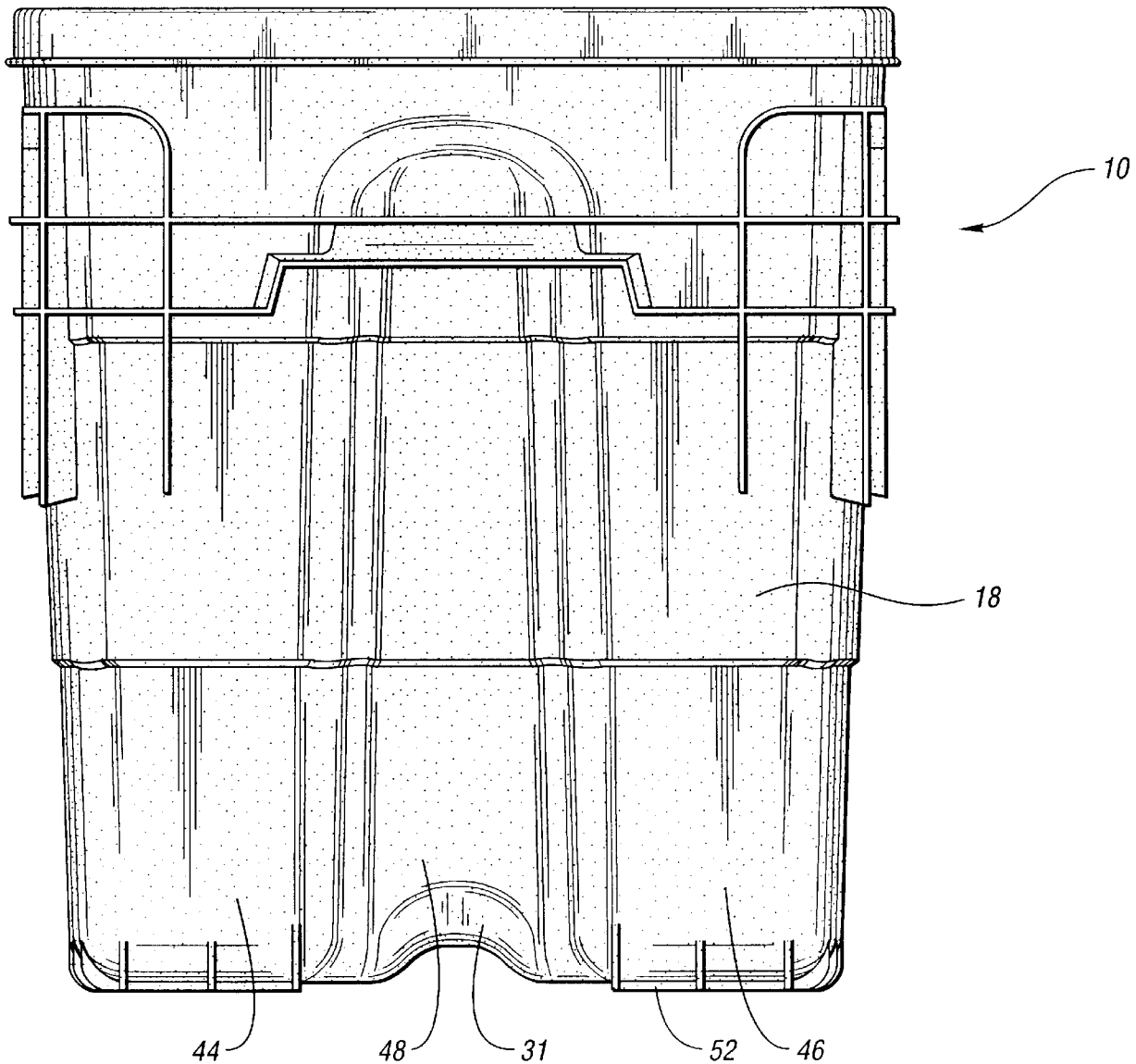
FIG. 5 is a left side elevational view of the storage container according to the present invention, the right side elevational view being a mirror image thereof.

FIG. 6 further illustrates that downwardly projecting portions 28 are separated by a pair of upwardly directed (or recessed) channel portions 30, 31 oriented substantially perpendicular to each other. Each channel portion 30 is shown as running from side wall 14 to side wall 16, and as illustrated in FIG. 4, is open at side walls 14, 16. As further illustrated, channel 31 is shown as running from end wall 18 to end wall 20 and, as best shown in FIG. 5, is open at end walls 18, 20. It is noted that recessed channels 30, 31 are deepest at their most outboard portions proximate their corresponding side and end walls, 14, 16, 18, 20. Note that channel recesses 30, 31 define raised projections 33, 35, respectively, in bottom inner surface 27, which project into compartment 17, as illustrated in FIG. 10 and the cross-sectional views of FIGS. 7 and 8.

As further shown in FIG. 6, each channel 30, 31 is particularly separated into two channel portions. For example, channel 30 includes channel portions 30*a* and 30*b* oriented opposite each other, whereas channel 31 includes channel portions 31*a* and 31*b* oriented opposite each other. As noted in FIGS. 2 and 6, each channel portion extends from its respective side or end wall inwardly where it is at its deepest, to the more narrow recessed central portion 32. Note that recessed central portion 32 defines a centrally oriented raised projection portion 37 into compartment 17.

Likewise, with further reference to FIGS. 2 and 6, each downwardly projected corner portion 28 is generally separated in a diagonal manner by a line 80, 81, 82, 83, which is generally positioned so that it runs from an outer corner of projecting portion 28 inwardly and upwardly toward its opposing corner and central portion 32. Each line 80, 81, 82, 83, defines for each projecting portion 28 a first projecting portion 36 and a second projecting portion 38. As more particularly noted in FIGS. 2 and 6, each of the first and second projecting portions 36, 38 have downwardly directed corner portions 40, 42, respectively (which are proximate recessed channel portions 30*a* and 31*b*, respectively), and extend in an upwardly inclined manner toward its corresponding line 80 (for example). Thus, each individual projecting portion 28 is concavely rounded toward its corresponding line 80, 81, 82, 83. Unless otherwise indicated, the descriptions provided herein and the use of the relative positioning terms such as upward and downward assume that the container is lid side up, with bottom surface 26 on the bottom.

Thus, the generally concave shape of bottom surface 26 allows base 12 to be bowed upward with a relatively slight arcuate shape, instead of having a typical flat profile. This bowed feature of bottom surface 26 serves to add stability to the container and augment the life of the container, as well as provide protection to the contents of containers stacked therebelow. Particularly, when container 10 is filled or has goods placed therein, the weight of the goods will exert load upon base 12. Under this load, the bowed design of bottom panel 14 will tend to cause bottom 14 to flatten. This is desirable in comparison to a container having a typically flat bottom which under the same load described above, will tend to sag and bow downward, thereby, decreasing the container's strength, stability, and life. Also, such sagging may possibly cause damage to the contents of the container therebelow if there is no lid on the subjacent container, or otherwise make stacking difficult if there is a lid disposed therebelow.

Thus, when container 10 is inverted and bottom surface 26 of container 10 is exposed to moisture or other liquids, this liquid will tend to be directed downward and outward from central portion 32, and roll off bottom surface 26 via channels 30, 31, as illustrated by arrows 90 and 91 in FIG. 2.

Figure 11:
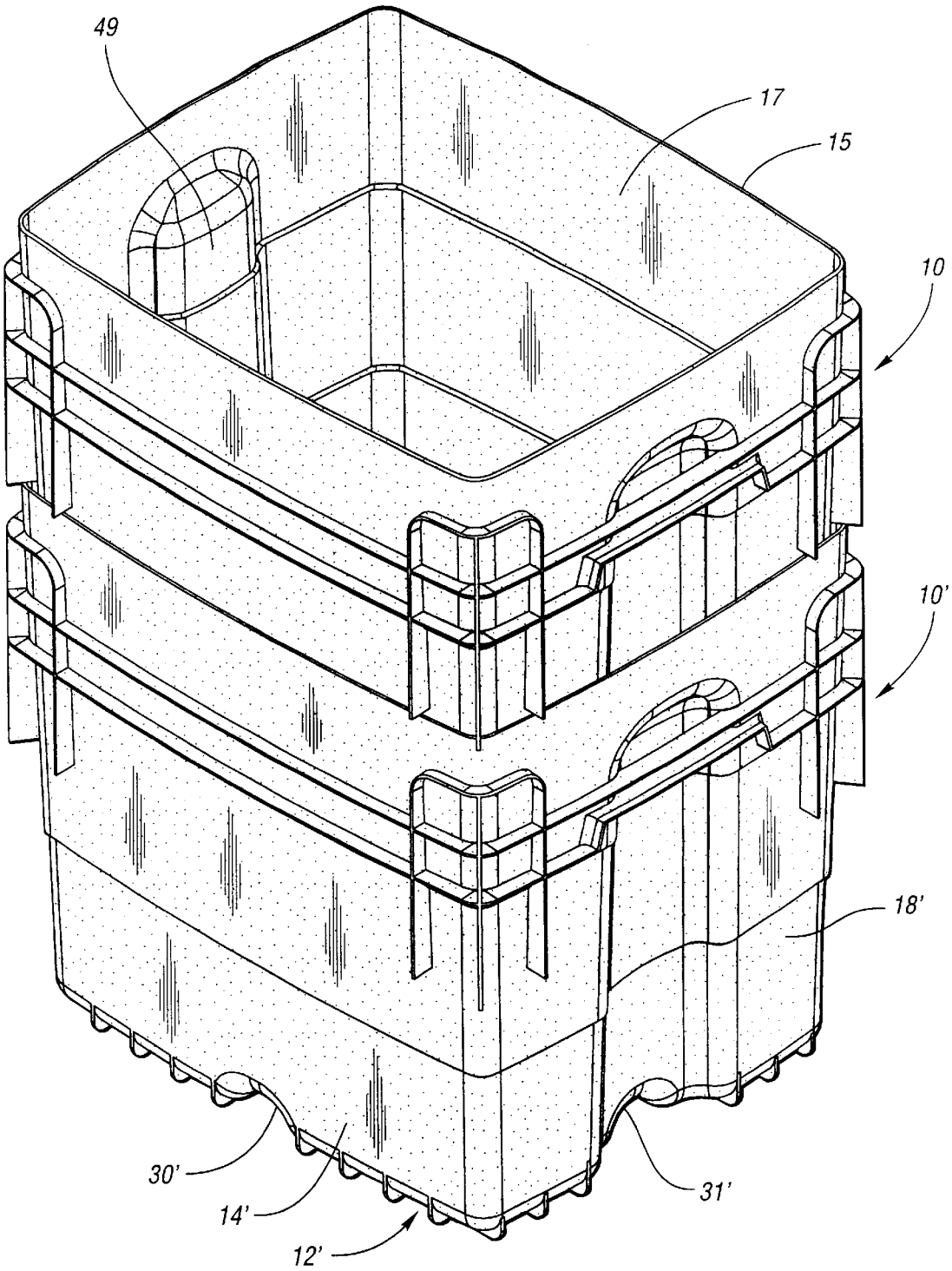
FIG. 11 is a perspective view of the storage container of FIG. 10 in a nested orientation with a like container.
Figure 12A:
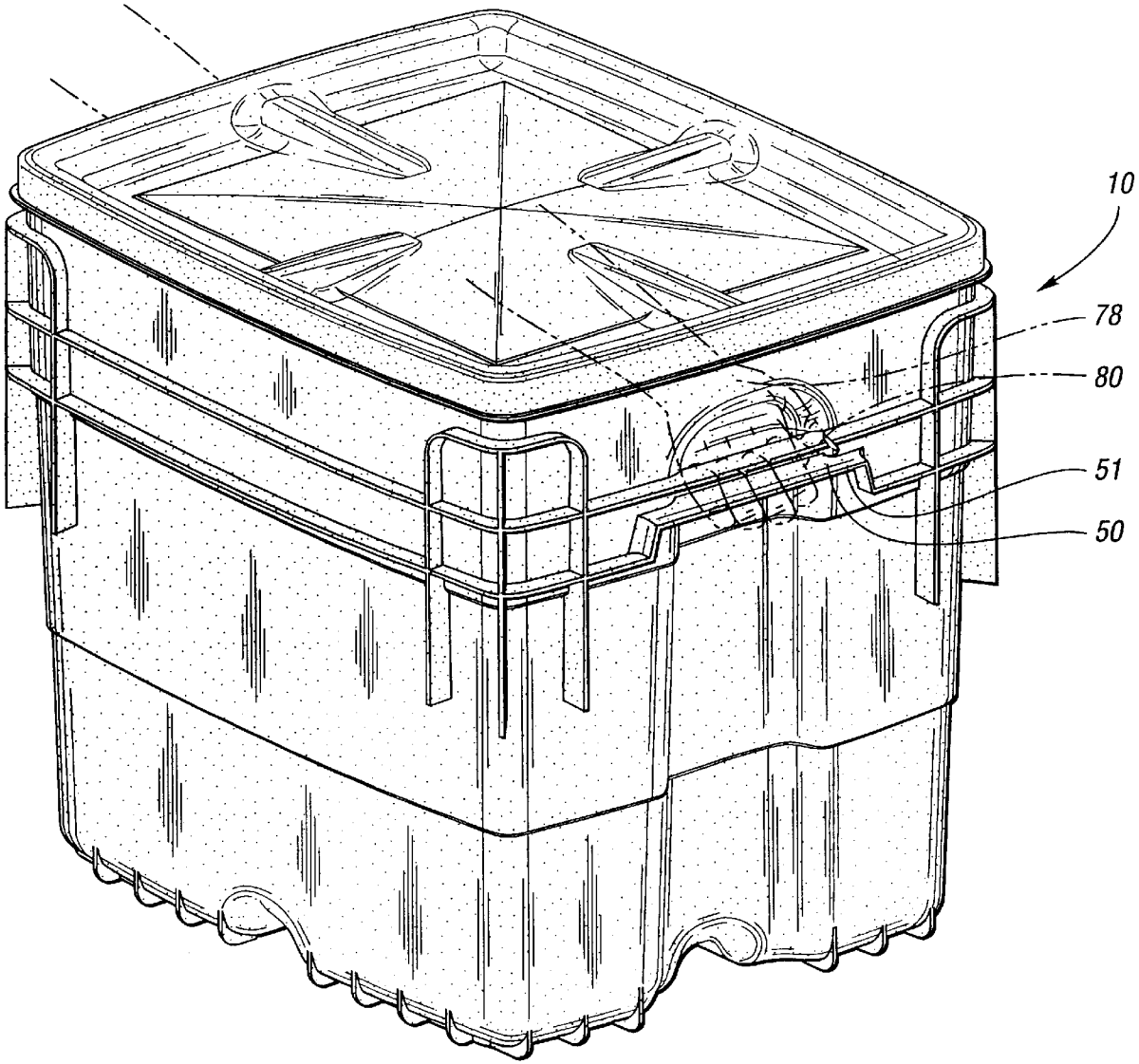
FIG. 12*a* illustrates a perspective view of the container of FIG. 1 showing a user's hands grasping the handle portion in a "palm-up" orientation.
Figure 12B:
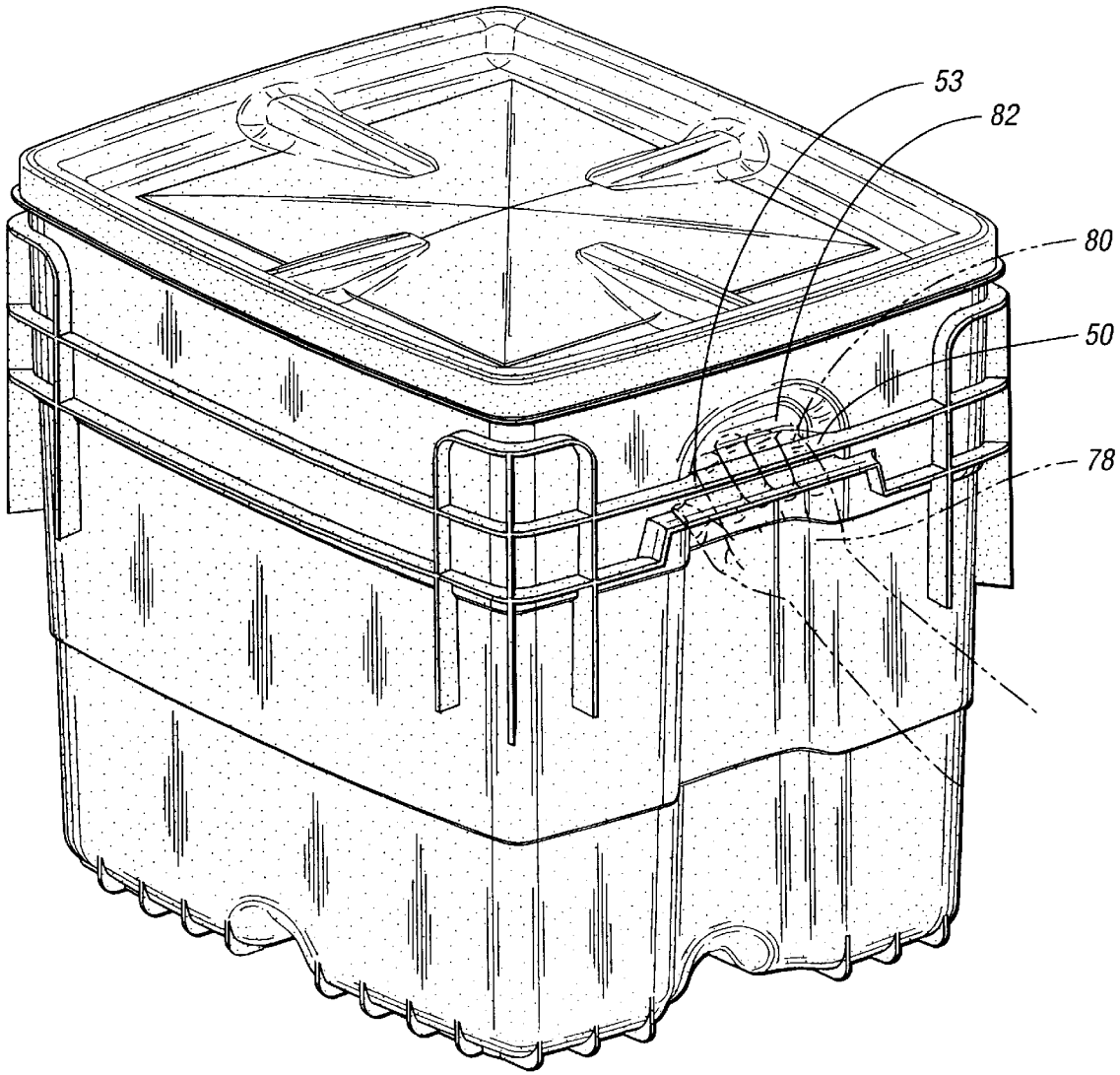
FIG. 12*b* illustrates a perspective view of the case of the container of FIG. 1 showing the user's hands grasping the handle portion in a "palm-down" orientation.

With reference to FIGS. 1 and 5, end walls 18, 20 as illustrated have a pair of outer portions 44, 46 and a central recessed portion 48 disposed between outer portions 44,46. Note that central recessed portion 48 is shown in FIG. 11 as portion 49 projecting into container 17. Container 10 also includes a handle portion 50 which provides for the user and handler of container 10 a way of lifting and transporting container 10. Handle 50 is shown generally as a member which extends across end walls 18,20 and is adapted to be grasped where it crosses recessed portion 48. Thus recessed portion 48 provides a hand-opening (or finger opening) area 82 for the user to insert his hands/fingers therein for handling container 10. As shown in FIG. 12*a* and FIG. 12*b*, handle 50 may be grasped by a user in both a palm-up and palm-down hand orientation, respectively.

FIG. 12*a* illustrates handle member 50 of container 10 being handled by a user in a "palm-up" (or palm-in) orientation. Generally, the palm-up orientation is utilized by a user when container 10 is disposed on a floor, table or any other surface which generally would not necessitate that the user raise his/her hands above shoulder level. Accordingly, just as one would pick up a stack of books off the floor, the user wraps his hand 78 or various fingers 80 palm side up or toward container 10, around handle 50 (The fingers are inserted from outside container 10 toward the interior of container 10.) While lifting container 10, the user grasps lower edge 51 of handle member 50 while the fingers 80 are generally curling upward into finger/hand opening area 82. Hence the palm-up orientation is provided by this lifting and handling procedure.

Reference is now made to FIG. 12*b* which illustrates the "palm-down" orientation for a user handling container 10. Generally, the design accommodates a user who, for example, reaches overhead and pulls container 10 off of a high stack of full (or partially full) stacked containers 10, or pulls container 10 off of a high shelf, which would typically necessitate that the user raise his/her hand(s) above shoulder level. In this manner, the user would insert fingers 80 into the upper opening of finger/hand receiving area 82, grasping upper edge 53 of handle member 50. Thus, in this orientation, the user may reach overhead and maneuver or slide container 10. Of course, this "palm-down" orientation may also be used when container 10 is empty (and thus has a lighter weight than when full or partially full) or, of course, when the user has sufficient strength to lift the case from the contemplated overhead position. In fact, it is fully contemplated that a user may lift container 10 single-handedly using the palm-down orientation.

Referring to FIGS. 1–5, bottom 12 further includes a drag rail 52 extending around the periphery of bottom surface 26. Drag rail 52 includes a plurality of ribs 54 or other projections. As previously discussed, the outward portion of bottom surface 26 at drag rail 52 is the most downwardly projecting portion of bottom portion 12. Accordingly, when container 10 is dragged or otherwise slid across a surface, drag rail 52 should bear the majority of the wear and friction placed on container 10 against another surface.

Figure 3:
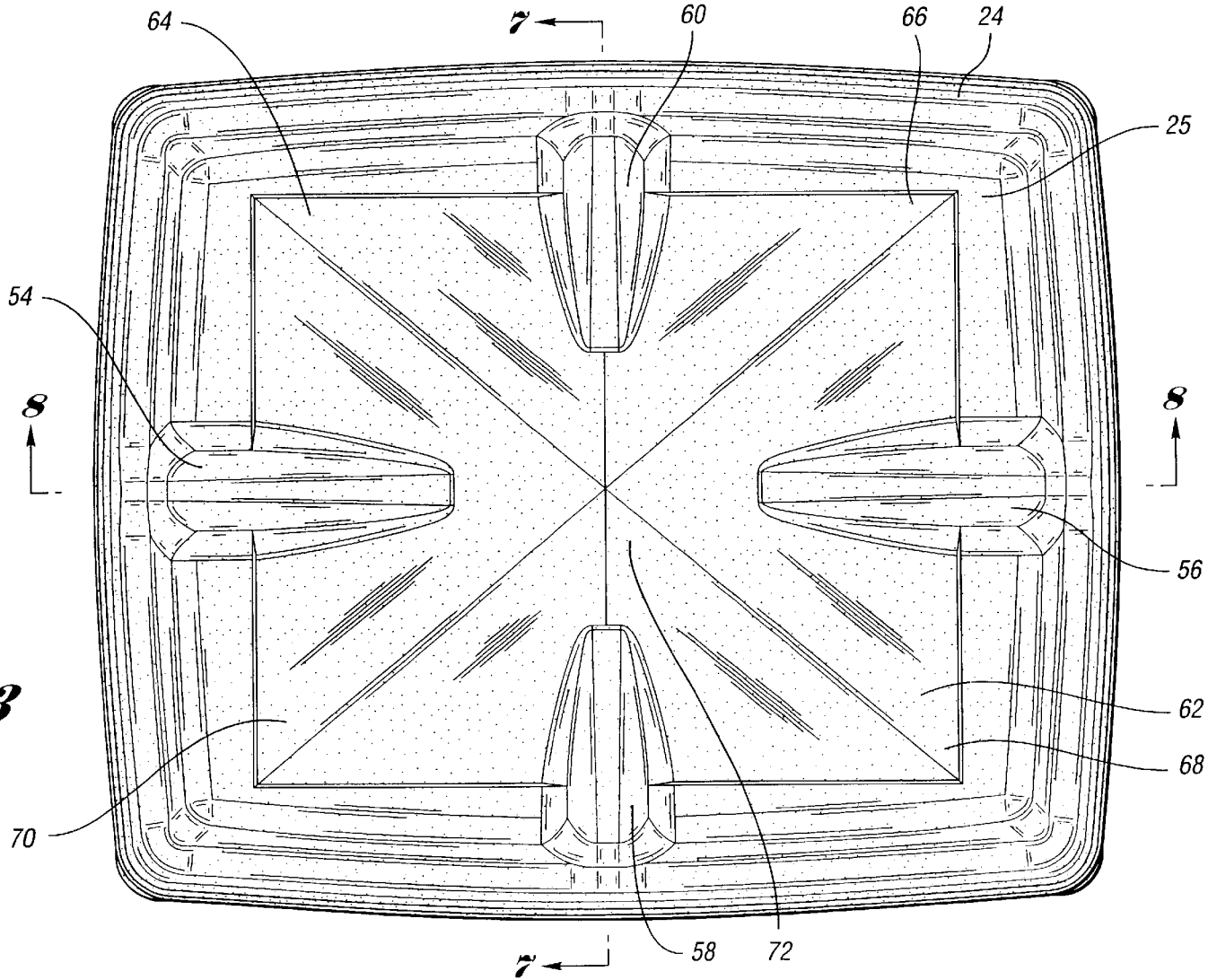
FIG. 3 is a top plan view of the storage container of the present invention, and particularly showing a plan view of a lid attached to the storage container.
Figure 9:
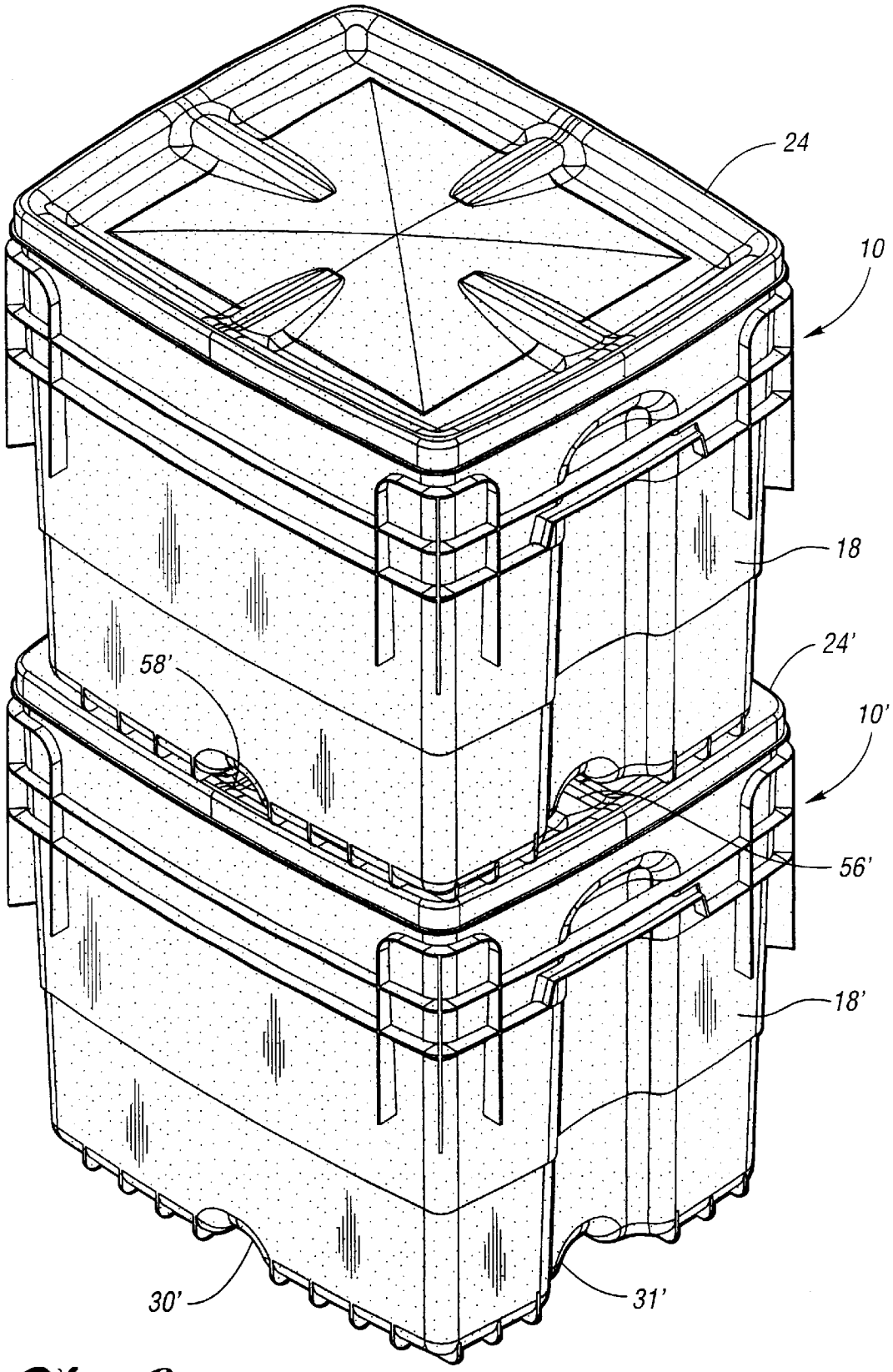
FIG. 9 is a perspective view of the storage container of FIG. 1 in a stacked orientation with a like container.

As illustrated in FIGS. 1, 3, and 9, lid 24 is shown having an upper surface 25 which substantially corresponds to bottom surface 26 of container 10. Accordingly, in a stacked orientation wherein one container 10 is stacked on top of a second container 10'. Like components of container 10' are designated by a like reference numeral with a prime (') designation. When container 10' has a lid 24' positioned thereon, bottom surface 26 of container 10 and upper surface 25' of lid 24' are designed to correspond to and mate with each other. In keeping with the present invention, as noted in FIGS. 1 and 3, upper surface 25 of lid 24 includes a plurality of centrally disposed projections directed upwardly from lid top surface 25. More particularly, when in a stacked orientation with like container 10' as illustrated in FIG. 9, projections 54, 56, 58, 60 meet and mate with corresponding upwardly directed channel portions 31*b*, 31*a*, 30*a*, 30*b*, respectively. As noted, upwardly directed projections 54, 46, 58, 60 are designed such that they extend upwardly from top surface 25 and inwardly from outboard portion of lid 24 such that they mate securely with their corresponding recessed channel portions.

Lid 24 also includes a recessed area 62, including corner recessed portions 64, 66, 68, 70, and central recessed area 72. Thus, when container 10 is in a stacked orientation with like container 10' as shown in FIG. 9, these recessed portions mate with and securely receive therein corresponding downwardly directed portions 28 of bottom surface 26.

Note that the upper portion of each corner portion 22 of container 10 includes an outwardly projecting ridge structure 74 for providing strength to the upper portion of container 10.

With reference to FIGS. 1, 9 and 11, container 10 is also tapered from upper portion to bottom portion such that when lid member 24 is removed (as illustrated in FIG. 10), container 10 may receive therein (or be received within) a like container 10' in a nested orientation (see FIG. 11). Accordingly, it is noted that the outwardly projecting rib structure 74 in corner portions 22 of container 10 may provide a stop which limits the travel of container 10 into container 10' during nesting. Also note that lid 24 may be designed such that when container 10 is empty, lid 24 may be positioned within the compartment 17 of container 10 for storage and transport purposes.

Figure 13:
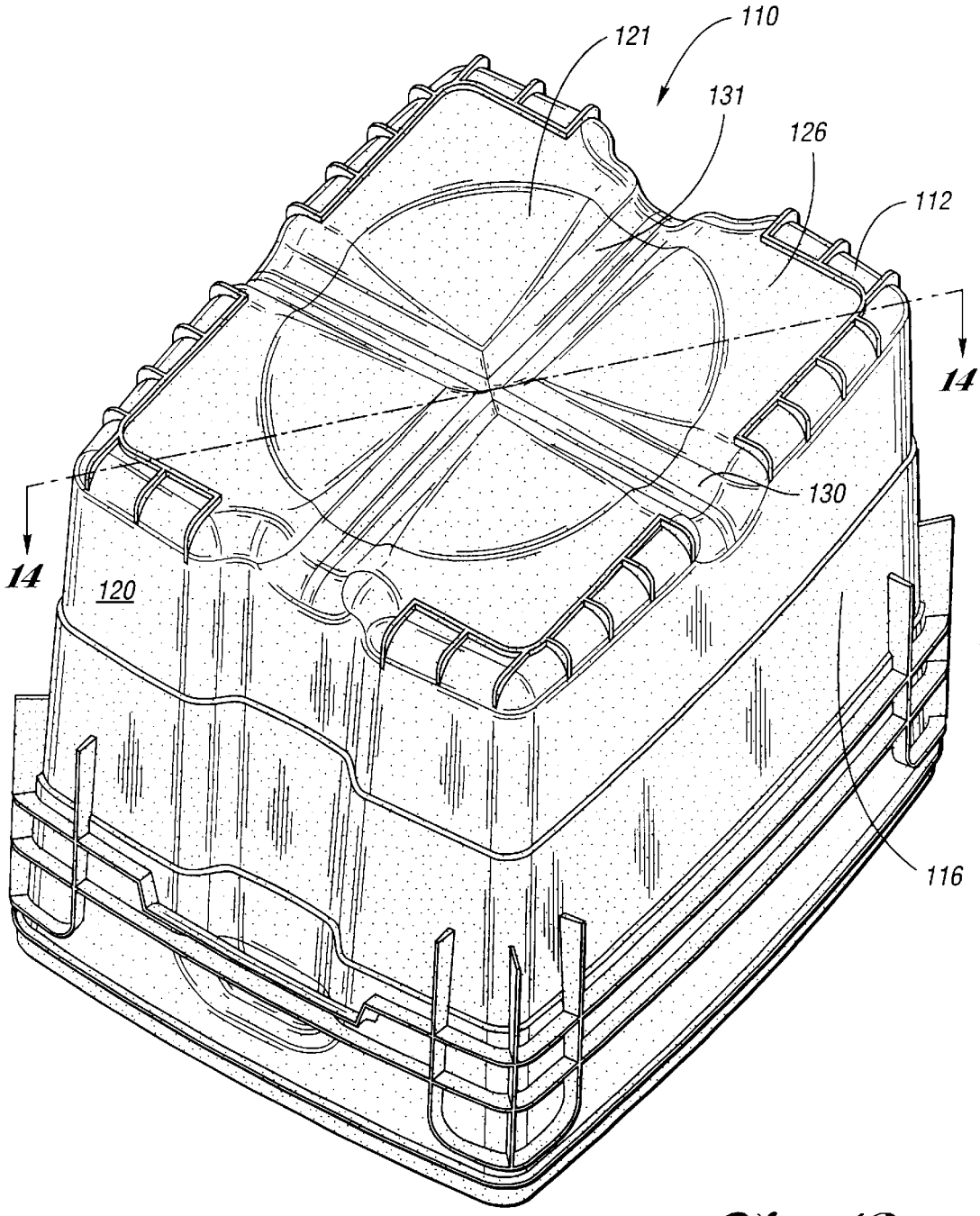
FIG. 13 illustrates a bottom perspective view of a second embodiment according to the present invention.
Figure 14:
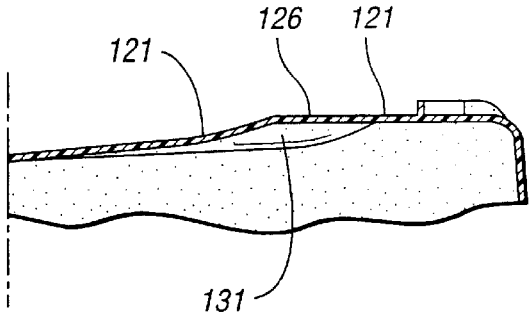
FIG. 14 illustrates a partial cross-sectional view taken along the line 14—14 of FIG. 13.

FIG. 13 presents a bottom perspective view of a second embodiment of the container 110 according to the present invention, wherein components similar to those of the first embodiment have a like reference numeral with the addition of a "1" prefix thereto. As illustrated therein, bottom portion 112 of container 110 includes an outer surface 126 and recessed portions 130, 131. Note that outer surface 126 also has a concave shape as designated by area 121. FIG. 14 is a partial cross-sectional view taken along the line 14—14 of FIG. 13, illustrating the concave shape of bottom outer surface 126.

Figure 15:
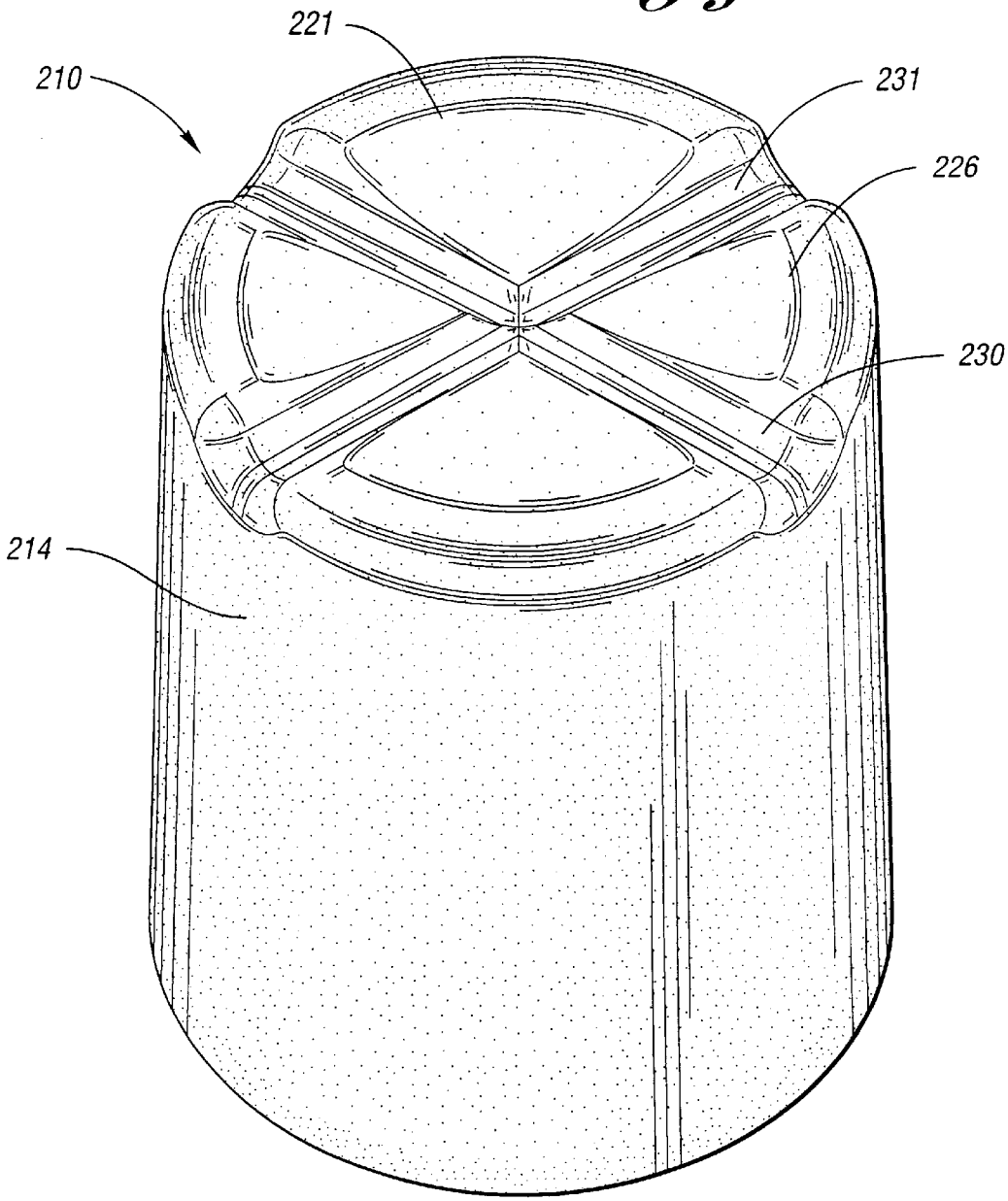
FIG. 15 illustrates a bottom perspective view of a third embodiment according to the present invention.

FIG. 15 presents a bottom perspective view of a second embodiment of the container 210 according to the present invention, wherein components similar to those of the first embodiment have a like reference numeral with the addition of a "2" prefix thereto. As illustrated in FIG. 15, container 210 includes a substantially cylindrical side wall portion 214 and an annular bottom portion 212 formed integrally therewith. Bottom portion 212 also includes a pair of recessed channel portions 231, 232, which are illustrated as being diametrical, oriented perpendicular to each other, and open at a corresponding portion of side wall portion 214. Like the previous embodiment, container 210 includes a more true concave outer surface 226, particularly designated by area 221. Of course, containers 10, 110, 210 may have any shape and size feasible according to the teachings of the present invention.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A plastic storage container comprising:

a bottom portion having an outer surface with a generally concave shape, the outer surface including at least one recessed portion formed therein for allowing drainage from the outer surface when the container is in an inverted orientation.

2. The plastic storage container of claim 1, further including a substantially cylindrical side wall portion integrally formed with the bottom portion.

3. The plastic storage container of claim 1, further including a first pair of opposed side walls and a second pair of opposed side walls integrally formed with each other and with the bottom portion.

4. The plastic storage container of claim 1, wherein the bottom portion includes a second recessed portion formed therein for allowing drainage from the outer surface when the container is in an inverted orientation.

5. A plastic container having a first pair of opposed side walls and a second pair of opposed side walls integrally formed with each other, the plastic container comprising:

a bottom portion formed integrally with the first and second pairs of opposed side walls, the bottom portion having an outer surface with a generally concave shape, the outer surface including at least one recessed portion formed therein for allowing drainage from the outer surface when the container is inverted.

6. The plastic container of claim 5, wherein at least one recessed portion bisects the bottom portion.

7. The plastic container of claim 5, wherein the bottom portion includes a second recessed portion extending between the second pair of opposed side walls.

8. The plastic container of claim 7, wherein the first recessed portion and the second recessed portion define a plurality of downwardly projecting portions.

9. The plastic container of claim 5, wherein the bottom portion has an inner surface with a corresponding convex surface corresponding to the generally concave shape of the outer surface.

10. A plastic container comprising:

a first pair of opposed side walls;

a second pair of opposed side walls integrally formed with the first pair of opposed sidewalls; and a bottom portion integrally formed with both the first pair of opposed side walls and the second pair of opposed side walls and defining a compartment thereby, the bottom portion having an outer surface with a recessed central area and at least one recessed channel portion extending radially between the recessed central area and one of the side walls for allowing drainage from the outer surface when the container is inverted, wherein the outer surface is angled inward from its periphery toward the central area such that the bottom portion is bowed gradually inward into the compartment.

11. The plastic container of claim 10, wherein the first pair of opposed side walls and the second pair of opposed side walls are vertically tapered.

12. The plastic container of claim 10, further comprising a lid cooperable with the container for enclosing the compartment.

13. The plastic container of claim 12, wherein the lid has an upper surface corresponding to the outer surface of the bottom portion, such that in when oriented in a stacked orientation, the lid is disposed on the plastic container and matingly receives a corresponding bottom portion of a like container thereon.

14. The plastic container of claim 10, further comprising a handle portion on at least one sidewall.

15. The plastic container of claim 10, wherein the bottom portion includes a second recessed portion extending between the second pair of opposed side walls.

16. The plastic container of claim 10, wherein the bottom portion has an inner surface with a corresponding convex surface.

17. A plastic container adapted to be nested with a like container, the plastic container comprising:

a first pair of opposed side walls;

a second pair of opposed side walls integrally formed with the first pair of opposed sidewalls; and a base portion integrally formed with both the first pair of opposed side walls and the second pair of opposed side walls and defining a compartment therein, the base portion having an outer surface defined by a generally concave shape and having a central area and at least one recessed channel portion formed in the outer surface extending from the central area to one of the side walls for allowing drainage from the outer surface when the container is inverted, wherein in a nested orientation the compartment of the plastic container receives a like container therein.

18. The plastic container of claim 12, wherein the first pair of opposed side walls and the second pair of opposed side walls are vertically tapered.

19. The plastic container of claim 17, further comprising a lid cooperable with the container for enclosing the compartment, the lid having an upper surface corresponding to the outer surface of the base portion, such that in a stacked orientation, the lid disposed on the plastic container receives a corresponding base of a like container thereon.

20. The plastic container of claim 12, further comprising a handle portion on at least one sidewall, the handle adapted to be grasped in both a palm-up and palm-down orientation.

21. The plastic container of claim 12, wherein the base portion includes a second recessed portion extending between the second pair of opposed side walls.

22. The plastic container of claim 17, wherein the at least one recessed channel portion is integrally formed with and open at its corresponding side wall.

23. The plastic container of claim 17, wherein the at least one recessed channel portion has a relatively shallow depth adjacent the central area, and a relative greater depth adjacent the side wall.

24. A storage container comprising:

a first and second pair of opposed side walls and a bottom wall formed as a unitary construction, the bottom wall having an outer surface formed with a center area and a plurality of alternating floor contact portions and recessed channels extending around the periphery of the outer surface, the recessed channels extending radially outward from the center area to a respective side wall for providing drainage from the bottom wall, wherein the floor contact portions have a generally concave surface having a curvature directed toward the center area.

* * * * *

UNITED STATES PATENT AND TRADEMARK OFFICE

CERTIFICATE OF CORRECTION

PATENT NO. : 6,308,858 B1
DATED : October 30, 2001
INVENTOR(S) : Gerald R. Koefelda It is certified that error appears in the above-identified patent and that said Letters Patent is hereby corrected as shown below:

Column 9,
Line 1, delete “12” and insert therefor -- 17 --
Line 10, delete “12” and insert therefor -- 17 --
Line 13, delete “12” and insert therefor -- 17 --

Signed and Sealed this

Twenty-seventh Day of May, 2003

JAMES E. ROGAN
*Director of the United States Patent and Trademark Office*